US006901854B2

(12) United States Patent
Masuch

(10) Patent No.: US 6,901,854 B2
(45) Date of Patent: Jun. 7, 2005

(54) DRIVE MECHANISM OF A PRINTING UNIT

(75) Inventor: Bernd Kurt Masuch, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/471,759

(22) PCT Filed: Feb. 5, 2002

(86) PCT No.: PCT/DE02/00415

§ 371 (c)(1),
(2), (4) Date: Mar. 2, 2004

(87) PCT Pub. No.: WO02/076743

PCT Pub. Date: Oct. 3, 2002

(65) Prior Publication Data

US 2004/0139870 A1 Jul. 22, 2004

(30) Foreign Application Priority Data

Mar. 26, 2001 (DE) ..... 101 14 801
Nov. 8, 2001 (DE) ..... 101 54 838

(51) Int. Cl.[7] ..... B41F 5/00

(52) U.S. Cl. ..... 101/216; 101/177; 101/181; 101/183; 101/248

(58) Field of Search ..... 101/216, 217, 101/218, 219, 177, 179, 180, 181, 184, 220, 221, 228, 247, 248, 137–138, 142–143

(56) References Cited

U.S. PATENT DOCUMENTS 3,732,815 A 5/1973 Greiner et al.
3,742,849 A 7/1973 Greiner et al.
4,154,165 A * 5/1979 Jeschke ..... 101/177
4,606,269 A 8/1986 Jeschke et al.
5,535,675 A * 7/1996 Gentle ..... 101/248
5,617,788 A * 4/1997 Horiguchi et al. ..... 101/181
5,706,725 A 1/1998 Kolbe et al.
5,771,804 A * 6/1998 Knauer et al. ..... 101/183
5,826,505 A * 10/1998 Volz et al. ..... 101/183
5,950,538 A 9/1999 Puschnerat
5,983,799 A * 11/1999 Lane et al. ..... 101/375
6,267,056 B1 7/2001 Kolbe et al.
6,334,389 B1 1/2002 Fischer
6,408,748 B1 6/2002 Hajek et al.

FOREIGN PATENT DOCUMENTS

| | | |
|---|---|---|
| DE | 2 014 070 | 10/1971 |
| DE | 2 014 753 | 10/1971 |
| DE | 25 53 768 B2 | 6/1981 |
| DE | 34 09 194 A1 | 9/1985 |
| DE | 40 01 626 A1 | 8/1990 |
| DE | 44 30 693 A1 | 3/1996 |
| DE | 195 16 085 A1 | 11/1996 |
| DE | 195 19 141 A1 | 12/1996 |
| DE | 196 03 663 A1 | 8/1997 |
| DE | 196 29 605 A1 | 1/1998 |
| DE | 197 55 316 C2 | 10/1999 |
| DE | 199 18 399 A1 | 11/1999 |
| EP | 0 644 048 B1 | 7/1999 |
| EP | 1 000 737 A1 | 5/2000 |
| GB | 2 309 668 A | 8/1997 |

* cited by examiner

*Primary Examiner*—Eugene H. Eickholt
(74) *Attorney, Agent, or Firm*—Jones Tullar & Cooper PC

(57) ABSTRACT

A drive mechanism is provided for a printing unit. The printing unit has an axially movable forme cylinder and a second cylinder that cooperates with the forme cylinder. The forme cylinder can be driven by a drive motor through a spur tooth gear. The second cylinder is driven by the forme cylinder through a drive connection between the two.

43 Claims, 7 Drawing Sheets

DRIVE MECHANISM OF A PRINTING UNIT

FIELD OF THE INVENTION

The present invention is directed to a drive mechanism for a printing unit. The printing unit has at least two cylinders, at least one of which may be axially movable. The two are driven by a common drive motor.

BACKGROUND OF THE INVENTION

A printing group with forme and transfer cylinders driven in pairs is known from DE 44 30 693 A1. The forme cylinder is driven and its output is transmitted to the transfer cylinder via spur wheels. A journal of the forme cylinder, embodied as a rotor, is axially displaceable in the stator for adjusting the lateral register on the forme cylinder.

EP 0 644 048 B1 discloses cylinders which are driven while coupled in pairs. The possibility of coupling an associated inking system with the driving connection of the pair is mentioned. In a schematic representation, the transfer cylinder is driven by the drive motor, and power is transferred from the transfer cylinder to the forme cylinder, and from the forme cylinder to the inking system.

In DE 196 03 663 A1, the forme cylinder, and the transfer cylinder that is acting together with it, are driven in parallel by a motor. The forme cylinder can be axially displaced by a gear, and can be displaced in the circumferential direction in relation to the transfer cylinder by the use a helical gear. An inking system, which is assigned to the forme cylinder, can be driven by a spur wheel arranged on the journal of the forme cylinder.

DE 20 14 070 A1 discloses a drive mechanism for a rotary printing press. Driving of a pair of cylinders consisting of forme and transfer cylinder takes place on the forme cylinder. In order to produce a definite driving connection in the frictional drive of two transfer cylinders acting together, the two transfer cylinders are non-positively, but releasably connected with each other.

DE 34 09 194 A1 discloses the drive mechanism of a cylinder pair by the use of a spur-toothed gear. Driving takes place from the drive motor via the gear to the transfer cylinder.

Driving of a four-cylinder printing unit with a drive mechanism acting on the respective forme cylinder is known from DE 20 14 753 A1. At least one of the transfer cylinders, driven by a respective forme cylinder, can be charged with a braking moment for preventing changing of tooth faces.

SUMMARY OF THE INVENTION

It is the object of the present invention to provide a drive mechanism for a printing unit.

In accordance with the present invention, this object is attained by the provision of the printing unit, having a forme cylinder that is axially shiftable and a transfer cylinder, with a common drive motor for both of the cylinders. The two cylinders are driven by the common drive motor via an at least partially spur-toothed gear. Power is transferred from the drive motor, via the at least partially spur-toothed gear, to the forme cylinder, and from the forme cylinder to the driving connection and to the transfer cylinder. Alternatively, the forme cylinder, and the transfer cylinder, which is in positive driving connection with the forme cylinder, are driven via a gear by a common drive motor. A counter-pressure cylinder that is assigned to this cylinder pair is driven by a separate drive motor. A gear is arranged between the separate drive motor and the counter-pressure cylinder.

The advantages to be realized by the present invention consist, in particular, in that by the forme cylinder being driven, no movement of the drive motor needs to be performed in the print-on and print-off position of the transfer cylinder, such as would be the case with some direct drives of the transfer cylinder. A compromise, which is typically based on such a pivot movement of the transfer cylinder in connection with the position of the drive motor and the engagement of the gear wheels when arranging the drive motor at the transfer cylinder can be omitted when the forme cylinder is being driven. In the prior case, the gear wheel engagement can lead to tooth breakage, or to a reduction of the printing quality because of the play in the drive mechanism.

The drive mechanism of the printing unit of the present invention is independent of the drive mechanism of a further cylinder of an additional or printing unit which may be constituting a printing position with the printing unit, and the drive mechanism preferably does not have a mechanical, and in particular a positively connected drive connection with the further cylinder or additional printing unit.

If only an inking system and the transfer cylinder are embodied for being brought into, or out of contact, a rigid coupling of the drive motor with a lateral frame can take place.

A spur-toothed pinion of the drive motor can transfer power directly to a spur-toothed spur wheel on the journal of the forme cylinder. The teeth and the axial movement are configured in such a way that the stability values, for example degrees of contact and breaking strength, are assured.

In another embodiment of the drive mechanism in accordance with the present invention, the drive motor can be arranged directly axially in relation with the forme cylinder. In order to make possible an axial movement of the forme cylinder for a change of the lateral register, a spur-toothed gear or a coupling, which is flexible in the axial direction, can again be arranged between the forme cylinder journal and the drive motor. The embodiment of the drive motor with a planetary gear arranged between the rotor and the journal of the cylinder is advantageous in respect to advantageous rpm ranges, in particular in the start-up phase.

In cases wherein stability requires helical gears for the force transmission, an arrangement is of advantage wherein the pinion of the drive motor does not transfer power directly to the spur wheel of the forme cylinder. If no additional precautions were to be taken, with an axial movement of the forme cylinder, a simultaneous displacement of the circumferential register would take place. Precautions could be, for example, a simultaneous correction by use of a control device, which correction requires technical control outlay, or a permissible movement of the pinion with respect to the spur wheel of the forme cylinder. This, however, requires guide devices, which cannot be produced, or which can be produced only with a large outlay, without play in the circumferential direction. In an advantageous manner, a coupling, which is flexible in the axial direction, can again be employed for the axial mobility of the forme cylinder.

Driving of the forme cylinder, namely via a spur-toothed gear, is advantageous, because the pivot movement of the transfer cylinder must be compensated for, and only the forme cylinder must have a lateral register displacement device at the same time.

It is advantageous in connection with the discussed embodiments of the drive mechanism for the forme cylinder, if an inking system which is assigned to the forme cylinder and, if provided, also a dampening system assigned to the forme cylinder, are driven by the same drive motor. This saves expense and, assuming the correct gear ratio conditions, assures synchronization.

For the exact and accurate rotation of the cylinders and rollers during production, a common flow direction of the moments or the torque from the drive motor to the various units to be driven is particularly advantageous. In an advantageous embodiment, this is achieved because driving takes place from the forme cylinder to the transfer cylinder, and from the transfer cylinder to the inking system, i.e. serially. In this connection, an embodiment is particularly economical wherein the driving takes place from the transfer cylinder to the inking system via a gear wheel that is rotatably arranged on the journal of the forme cylinder.

If the inking system and the transfer cylinder are driven in parallel, the use of auxiliary runners, in case of gear wheel trains, or the use of belt drives, which are as free of play as possible, is required at least for one of the two drive trains.

A coupling, which is flexible in the axial direction, and which is located between the drive motor and the forme cylinder, is preferably embodied as a torsionally rigid shaft coupling which, however, is flexible or resilient in the axial direction, and is configured for example, as an expansion coupling or as a compensation coupling. The employment of a non-switchable, positively-connected multi-disk coupling is particularly advantageous which coupling, in contrast to other positively-connected couplings, is almost entirely free of play in the circumferential direction, does not require an extensive production outlay and simultaneously makes an axial position change of the coupling itself, and thus an axial movement of the forme cylinder, possible. The coupling is embodied to be positively-connected in the axial direction, but to be flexible or resilient in its length, for example by elastic or reversible deformation.

The definite direction of the moment or torque flow is used for minimizing the play in the drive mechanism, and therefore for improving the printing quality.

The mechanical outlay for driving the cylinder pair can be considerably reduced by the use of a spur-toothed gear for driving the forme cylinder, while taking an out-of-contact movement, as well as a lateral register adjustment, into account.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
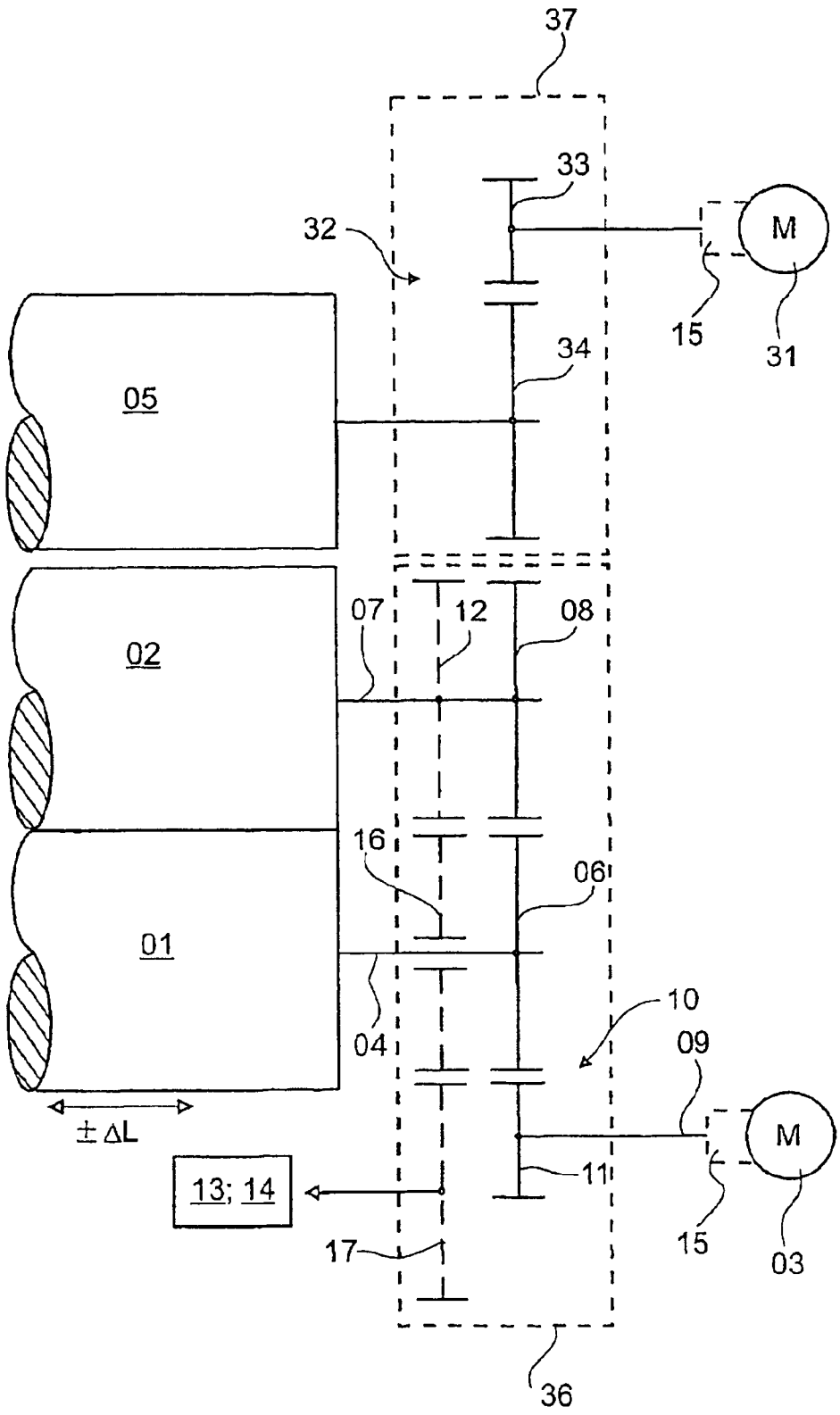
FIG. 1, a schematic depiction of a first preferred embodiment of the drive mechanism of a printing unit in accordance with the present invention, in FIG. 2, a second preferred embodiment of the drive mechanism of a printing unit, in FIG. 3, a third preferred embodiment of the drive mechanism of a printing unit, in FIG. 4, a fourth preferred embodiment of the drive mechanism of a printing unit, in FIG. 5, a fifth preferred embodiment of the drive mechanism of a printing unit, in FIG. 6, a sixth preferred embodiment of the drive mechanism of a printing unit, and in FIG. 7, a seventh preferred embodiment of the drive mechanism of a printing unit in accordance with the present invention.

Referring initially to FIG. 1, there may be seen a first preferred embodiment of a drive mechanism of a printing unit in accordance with the present invention. A printing unit of a printing press has a first cylinder 01, for example a forme cylinder 01, and a second cylinder 02, for example a transfer cylinder 02. The two cylinders 01, 02 can be driven together by the use of a first drive motor 03, which is in operative connection with the forme cylinder 01. The forme cylinder 01, in turn, drives the transfer cylinder 02 via a drive connection. During printing, the transfer cylinder 02 works together with, and forms a printing position with a third cylinder 05 which is only shown schematically in FIG. 1. For example the third cylinder 05 may be a second transfer cylinder 05 of a cooperating printing unit, or a counter-pressure cylinder 05 which does not transfer ink, for example a satellite cylinder 05. The drive mechanism of the third cylinder 05, or that of the cooperating second printing unit, is not in a positively connected driving connection with the printing unit which is driven by the first drive motor 03.

As represented in FIG. 1, a forme cylinder gear wheel 06 is arranged, fixed against relative rotation, on a journal 04 of the forme cylinder 01. A transfer cylinder gear wheel 08 is arranged, fixed against relative rotation, on a journal 07 of the transfer cylinder 02. Gear wheels 06 and 08 constitute the driving connection between the forme cylinder 01 and the transfer cylinder 02. In an advantageous embodiment, the driving connection has at least two members 06, 08, in this case the gear wheels 06, 08, which are both embodied as spur-toothed gear wheels and are movable in relation to each other in the axial direction. In this way, an axial movement between cylinders 01, 02 becomes possible without changing the relative position in the circumferential direction between cylinders 01 and 02.

In a first preferred embodiment of the present invention, as shown in FIG. 1, the drive of the forme cylinder 01 is provided via a first gearing arrangement 10 in that a motor gear wheel 11, for example a pinion 11, arranged on a shaft 09 of the drive motor 03, directly drives the gear wheel 06 arranged on the journal 04 of the forme cylinder 01. The gearing 10 from the drive motor 03 to the journal 04, or to the gear wheel 06, can also be provided by the use of a differently designed gear, for example via further gear wheels, via toothed belts, via bevel wheels, or in other ways.

For assuring the axial displaceability of the forme cylinder 01, which axial displaceability is indicated by a two-headed arrow in FIG. 1, the pinion 11, as well as the gear wheels 06, 08, are embodied to be spur-toothed. The position and width of the pinion 11 and of the gear wheels 06, 08 has been selected such that, with an axial displacement of the forme cylinder 01 by an amount $\Delta L$, a sufficient contact of the teeth is assured. The minimum contact is of such a size that the maximum load of the teeth, with respect to wear and breaking resistance, is not exceeded in any of the relative positions of the gear wheels 06, 11, or of a gear structured in another way, during operations.

The same applies to the driving connection constituted by the gear wheels 06, 08. If, for example, the forme cylinder gear wheel 06 is configured having a greater width and, in a zero position of the forme cylinder 01 acts together with the pinion 11 and the gear wheel 08 approximately in the center, only one of the gear wheels 06, 08, 11 of the drive train need to be provided with a greater width.

A reduction gear 15, for example a planetary gear 15 and/or an attached reducing gear 15, which is shown in dashed lines, can be arranged between the drive motor 03 and the gearing 10. This may be seen in FIG. 1.

A further transfer cylinder gear wheel 12 which is represented in dashed lines in FIG. 1, is arranged, fixed against relative rotation, on the journal 07 of the transfer cylinder 02. An inking system 13 assigned to the forme cylinder 01 and, if provided, a dampening system 14, are driven by this further transfer cylinder gear wheel 12. The the inking system 13 and the dampening system 14 are shown only as reference numerals in the drawing figures.

In the first preferred embodiment, the further transfer cylinder gear wheel 12 drives a further forme cylinder gear wheel 16, which is represented in dashed lines in FIG. 1, which is rotatably seated on the journal 04 of the forme cylinder 01 and which, in turn, meshes with a gear wheel 17, also represented in dashed lines of a drive mechanism, not further represented, of the inking system 13 and, if provided, of the dampening system 14.

The moment or torque flow in the drive system from the drive motor 03 via the forme cylinder 01 to the transfer cylinder 02, and from there to the inking system 13 and, if provided, to the dampening system 14 is definite, because it is serial. A tooth face change during load changes such as may occur during, for example, putting the cylinders 01, 02, the inking system 13, the dampening system 14, in or out of contact, or as a result of changes in the conditions, is avoided to a large extent. This leads to reduced wear and, in particular, to improved printing results.

Figure 2:
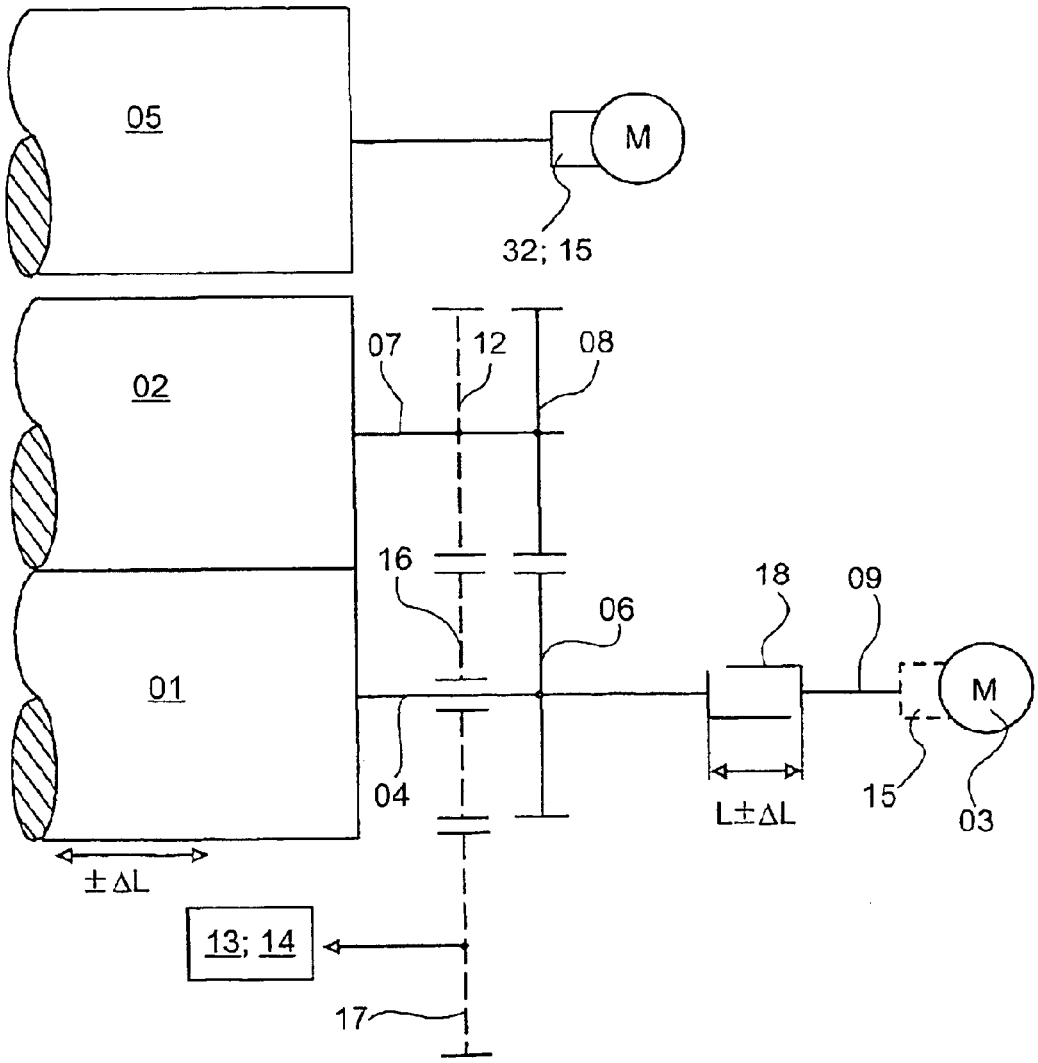

In a second preferred embodiment of the present invention, as seen in FIG. 2, the shaft 09 of the drive motor 03 is arranged coaxially with respect to an axis of rotation of the forme cylinder 01, and is connected, in a torsionally rigid manner, with the journal 04 of the forme cylinder 01. In one embodiment, a coupling 18, whose length L can be changed in the axial direction by an amount $\pm\Delta L$ is arranged between the drive motor 03 and the journal 04. This coupling 18 can be, in particular, an expansion coupling 18, a coupling 18 which is elastic in the axial direction, or a non-switchable shaft coupling 18 which, however is positively connected in the axial direction, but is resilient. An end of the coupling 18, which is facing away from the forme cylinder 01, is arranged to be fixed in place in respect to an axial direction. By the provision of the coupling 18, and with an axial displacement of the forme cylinder 01, the associated drive motor 03 for the forme cylinder 01 can be arranged fixed in place, or fixed on the frame. The amount $\Delta L$ of an axial displacement of the forme cylinder 01 preferably lies between 0 and ±4 mm, and in particular lies between 0 and ±2.5 mm. This axial displacement $\Delta L$, and is absorbed by the change of the length L of the coupling 06 by this amount $\pm\Delta L$.

A particularly suitable coupling 18 is a flexurally elastic, all-metal coupling, also called a diaphragm or ring coupling.

Figure 3:
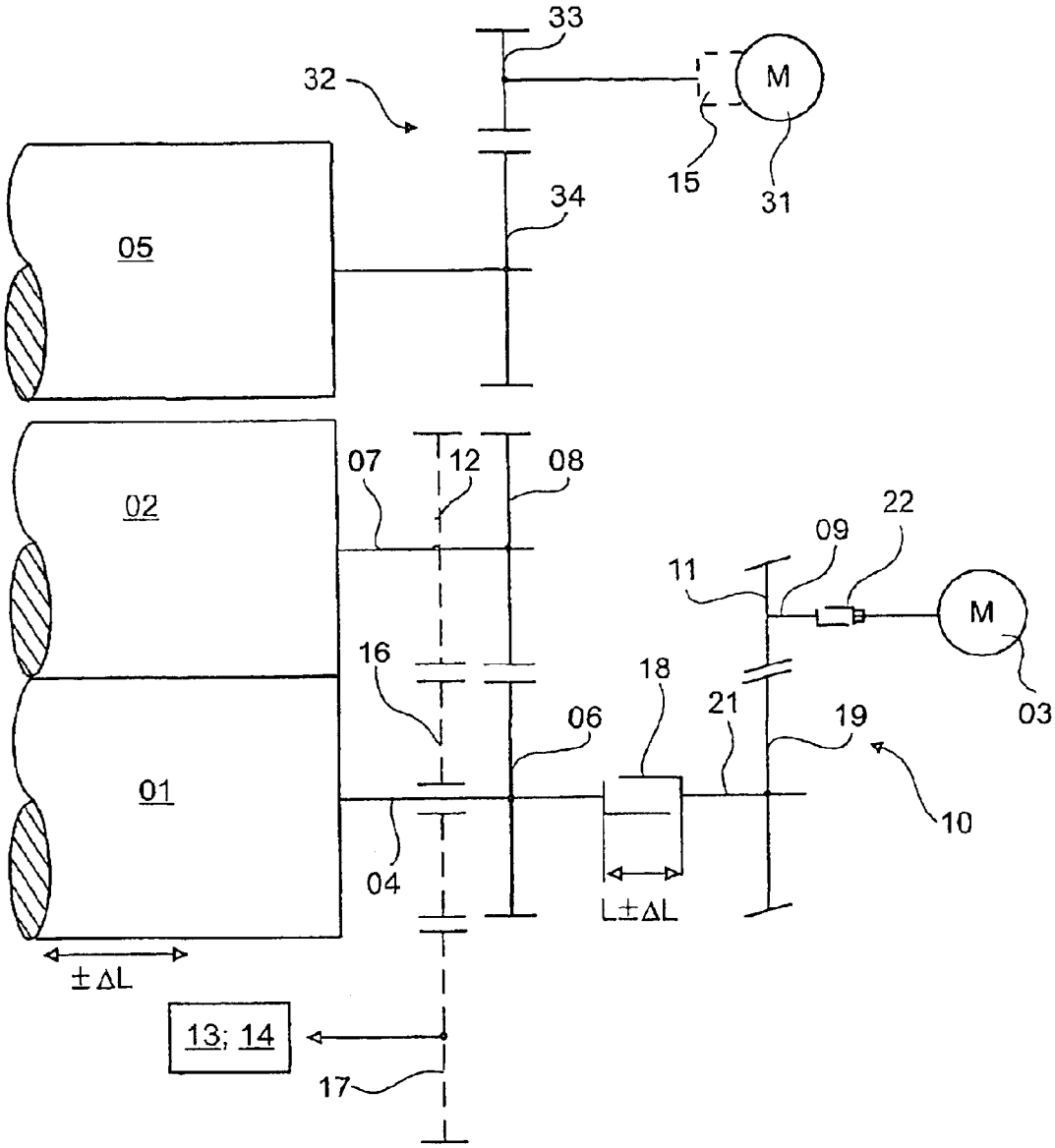

A third preferred embodiment of the present invention, as seen in FIG. 3, differs from the second preferred embodiment shown in FIG. 2 in that the drive motor 03 is not arranged coaxially in respect to the forme cylinder 01. Power is transferred from a pinion 11 connected with the motor shaft 09 of the drive motor 03 to a gear wheel 19, which is connected, fixed against relative rotation, via a shaft 21 or a journal 21, with the side of the coupling 18 which is facing away from the forme cylinder 01. This embodiment is particularly advantageous if, because of high loads, the demands made on the stability values, for example the degrees of contact and breaking strength, require helical gears on the pinion 11 and on the gear wheel 19. The two cooperating gear wheels 06, 08 on the journals 04, 07 of the cylinder 01, 02 are spur-toothed, for example, since, in this way, a relative movement in respect to each other is made possible without a compensation in the circumferential register being required. The inking system 13 and, if provided the dampening system 14 can also be driven, in a manner similar to the one disclosed in the second preferred embodiment, from the transfer cylinder 02.

For the purpose of easier disassembly, or maintenance, a claw coupling 22, for example, or a coupling 22 corresponding to the coupling 18, can be arranged between the drive motor 03 and the pinion 11. This coupling 22 is shown in FIG. 3.

Figure 4:
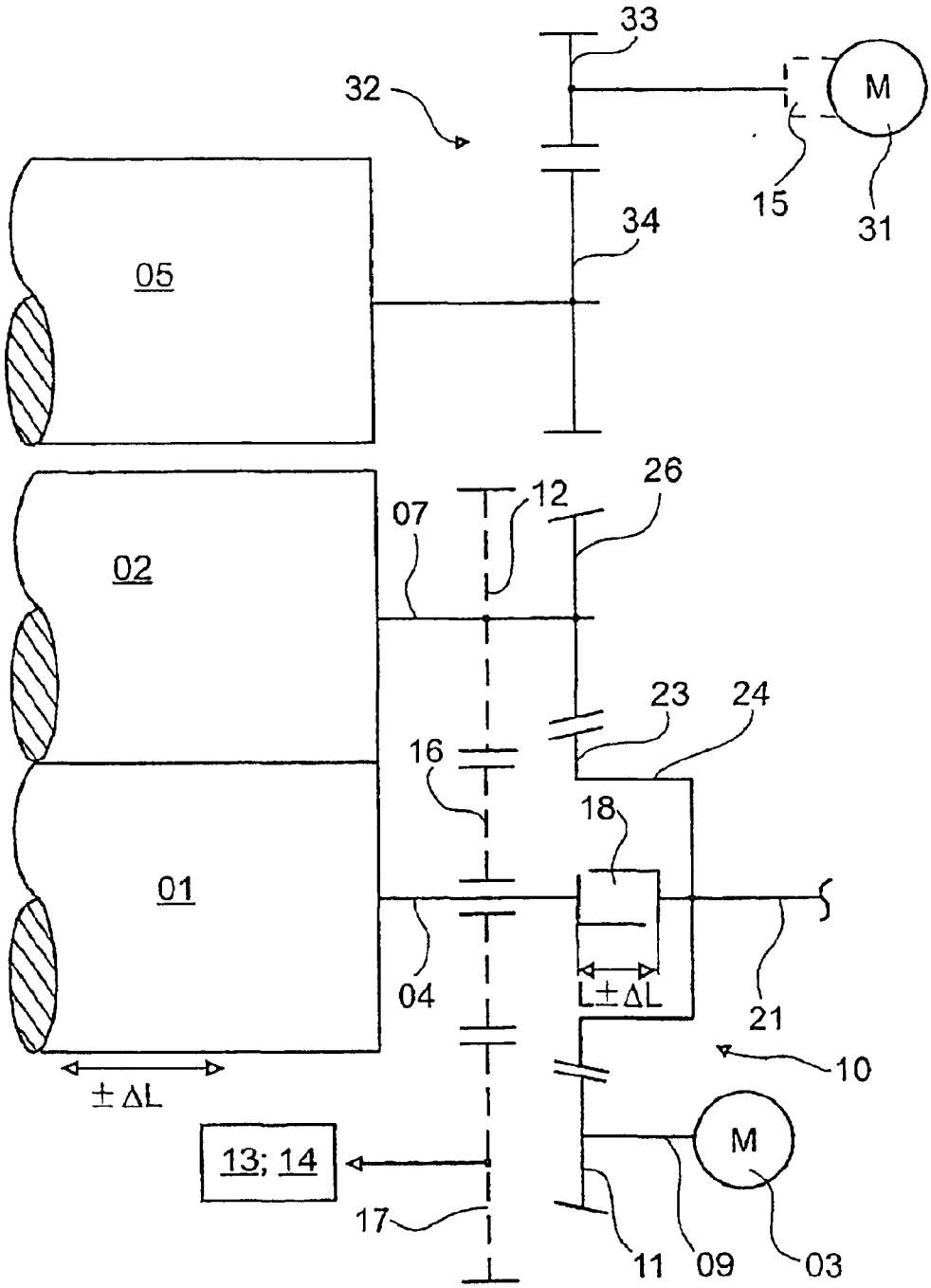

In a fourth preferred embodiment of the present invention, as seen in FIG. 4, the power transfer from the forme cylinder 01 to the transfer cylinder 02 does not take place on a side of the coupling 18 facing the forme cylinder 01, but instead takes place on the side of the coupling 18 which is not movable in the axial direction. For this purpose, the driving connection between the forme cylinder 01 and the transfer cylinder 02 is not arranged between the coupling 18, whose length L can be changed in the axial direction, and the forme cylinder 01, but on the side of the coupling 18 which is facing away from the forme cylinder 01 and which side of coupling 18 is stationary.

For the purpose of saving space, it is possible to connect a ring gear wheel 23, which is arranged, for example, on a bushing 24 that is enclosing the coupling 18, and which bushing 24 is connected with the side of the coupling 18 that is facing away from the forme cylinder 01. On one side, this ring gear wheel 23 meshes with a transfer cylinder gear wheel 26, which is connected, fixed against relative rotation, with the journal 07 of the transfer cylinder 02, and on the other side ring gear 23 meshes with the pinion 11. In comparison with the third preferred embodiment of the invention, as depicted in FIG. 3, one drive level can be saved with this fourth embodiment. Driving of the two cylinders 01, 31 can take place from the drive motor 03 via a helical gear. The driving connection formed by the helically toothed gear wheels 23 and 26 is not located on the side of the coupling 18 facing the cylinder 01, which is to be moved axially, but on the side of the coupling 18 which is stationary in respect to an axial movement.

Figure 5:
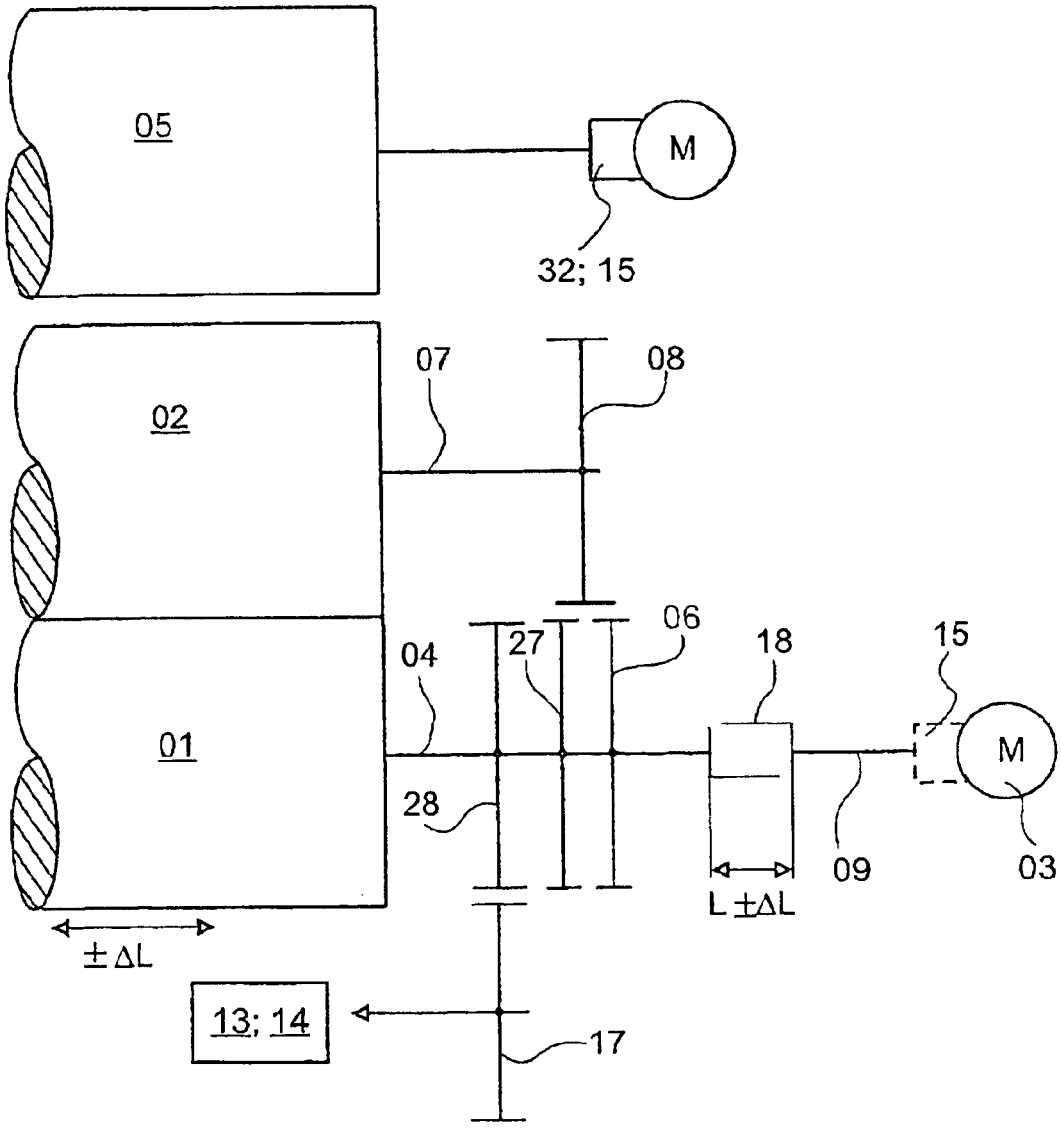

A fifth preferred embodiment of the present invention is depicted in FIG. 5 and shows a drive for a printing unit, wherein the forme cylinder 01 is driven by the drive motor 03, and power is transferred parallel from the forme cylinder 01 to the drive motor 03 and also to the inking system 13 and, if provided also to the dampening system 14. In spite of an undefined direction of the moment or torque flow, a tooth face change is prevented in the case of changing loads. The gear wheel 06, for example, arranged on the journal 04 of the forme cylinder 01, is that is arranged together with a further gear wheel 27, specifically an auxiliary gear wheel 27. Power can be transferred to the gear wheel 17 which is leading to the drive mechanism of the inking system 13 and, if provided the dampening system 14 via a gear wheel 28, which is also arranged, fixed against relative rotation, on the journal 04 of the form cylinder 01. For the purpose of axially displacing the forme cylinder 01, the gear wheels 06, 08, 27, and/or 17, 28, are spur-toothed.

As represented in FIG. 5, driving of the gear wheel 06, which is arranged, fixed against relative rotation, on the forme cylinder 01, can take place via the coupling 18 in one of the ways depicted and discussed above either coaxially in relation to the forme cylinder 01, in accordance with the second preferred embodiment, FIG. 2, or via a pinion 11, which is not specifically represented in FIG. 5, in accordance with the third preferred embodiment.

Figure 6:
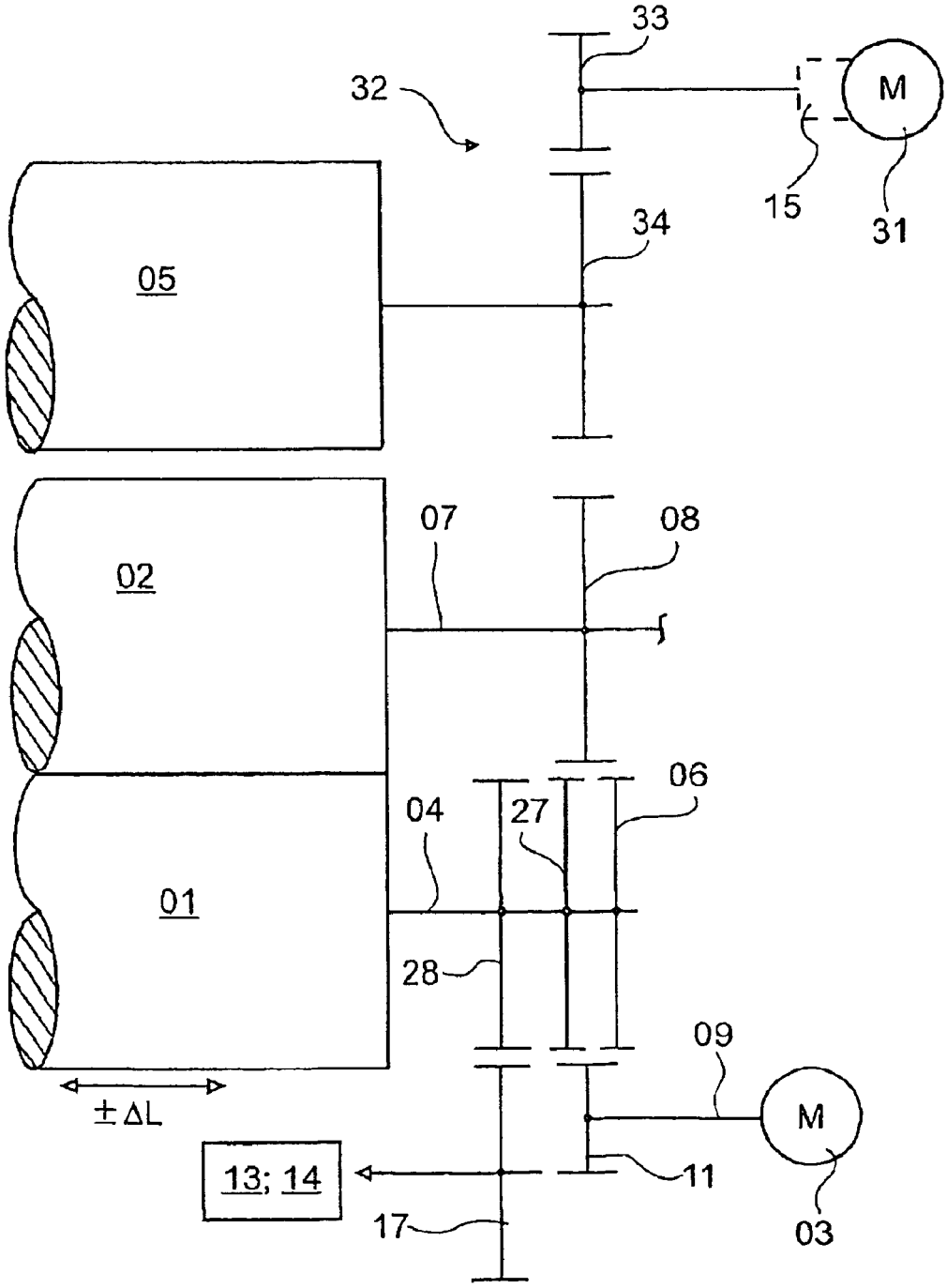

In the sixth preferred embodiment of the present invention, as seen in FIG. 6, the driving of the gear wheel 06, configured in accordance with the fifth preferred embodiment, and which is arranged fixed against relative rotation on the forme cylinder 01, takes place by the pinion 11 directly meshing with this gear wheel 06. In a manner the same as that discussed in connection with FIG. 5, power is transmitted parallel from the gear wheel 06 to the transfer cylinder 02 and to the inking system 13 and, if provided to the dampening system 14. In an advantageous embodiment, the gear wheels 06, 08, 27, and/or 17, 28, are embodied to be spur-toothed for the purpose of axially displacing the forme cylinder 01.

Figure 7:
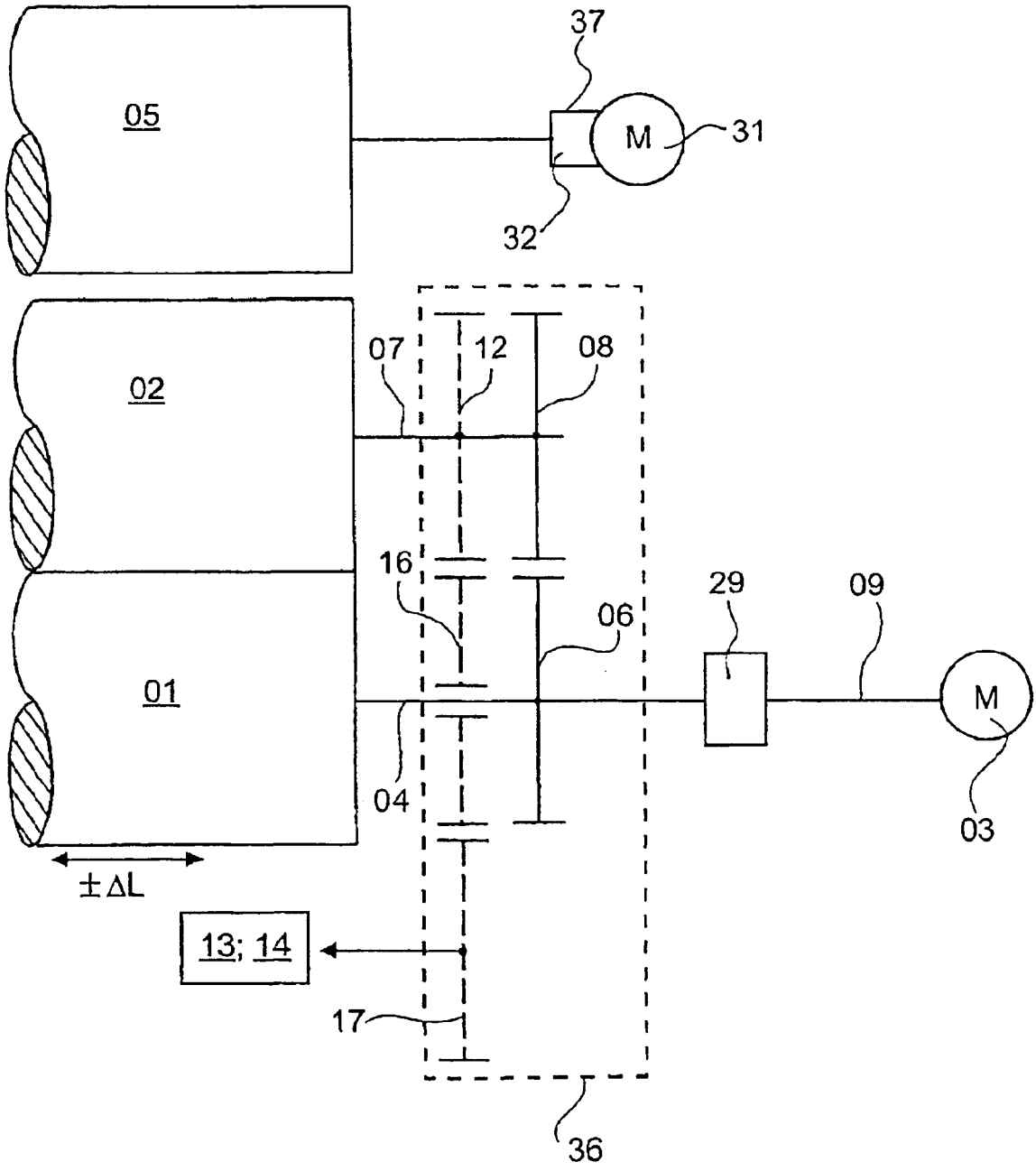

In a seventh preferred embodiment of the present invention, as seen in FIG. 7, the shaft 09 of the drive motor 03 is arranged coaxially with respect to an axis of rotation of the forme cylinder 01, and is connected in a torsionally rigid manner with the journal 04 of the forme cylinder 01. In an advantageous embodiment, a gear 29, for example a spur-toothed planetary gear 29, is arranged between the drive motor 03 and the journal 04, which gear 29 permits an axial displacement of the forme cylinder 01 by an amount $\Delta L$. The amount $\Delta L$ for an axial displacement of the forme cylinder 01 preferably lies between 0 and ±4 mm, and in particular lies between 0 and ±2.5 mm. This axial displacement is absorbed by the spur-teeth of the gearing, which mesh and which are displaceable with respect to each other.

For all of the preferred embodiments, and in particular for the second, fourth and fifth embodiments, shown in FIGS. 2, 4 and 5, with a drive motor 03 arranged coaxially with respect to the forme cylinder 01, a planetary gear, that is not specifically represented, can also be arranged in an advantageous further development on the drive motor 03, or between the drive motor 03 and the driving connection between the forme cylinder 01 and the transfer cylinder 02.

The driving connection 06, 08, 23, 26 between the two cylinders 01, 02, and/or the driving connection 12, 16, 17 between one of the cylinders 01, 02 and the inking system 13 and, if required the dampening system 14, can also be provided, instead of the embodiment as wheel trains 06, 08, 23, 26, or 12, 16, 17, alternatively as toothed belts, taking into consideration a reversal of the direction of rotation, or as other positively-connected drive connections.

In an advantageous further development of the preferred embodiments, a third cylinder 05, as depicted in FIGS. 1–7, and which is, for example, embodied as a satellite cylinder 05, is driven by its own, second drive motor 31 via a gear 32. In the first preferred embodiment shown in FIG. 1, the second drive motor 31 drives a pinion 33 for this purpose, which pinion 33 drives a gear wheel 34 that is arranged on the journal of the satellite cylinder 05. The gear drive 32 can also be configured in different ways, for example with several gear wheels, with a belt drive, or as a reducing gear drive 32 arranged coaxially in respect to the satellite cylinder 05, for example a planetary gear 32, and/or as an attached gear 32 connected with the second drive motor 31.

Driving of the cylinder pair consisting of the forme and transfer cylinders 01, 02, as well as the satellite cylinder 05, via respectively one gear 11, 06, 33, 34 allows the selection of a suitable reduction gearing, or the employment of smaller, and similarly dimensioned, if possible, drive motors 03, 31.

An embodiment of the present invention is advantageous wherein the drive mechanism of the cylinder pair 01, 02, and the drive mechanism of the satellite cylinder 05 are arranged in different, separate lubricant chambers 36, 37, as seen in FIG. 1. For example, the driving connection 06, 08, 23, 26 between the forme and transfer cylinders 01, 02, possibly together with the driving connection 12, 16, 17, 19 to the inking system 13, if such is provided, has its own housing 36, as depicted in dashed lines in FIG. 1, in which a thin-bodied lubricant, for example, in particular oil, is contained. If it is not embodied directly as an auxiliary gear 15, 29 on the drive motor 03, the gear 10, 15, 29 can also be arranged in this lubricant chamber, as is shown, by way of example, in FIGS. 1 and 7.

The gearing 10 between the drive motor 03 and the drive connection 06, 08 can be arranged, individually encapsulated, in its own lubricant chamber, in particular in case where power is coaxially transmitted to the forme cylinder 01, and/or the gear 10, 15, 29, or an additional gear 15, 29, is separate from the driving connection 06, 08.

If not arranged as an attached gear 15 directly on the second drive motor 31, the gear drive 32, and the gear 15 of the satellite cylinder 05 is arranged in a lubricant chamber inside the housing 37, which differs from the first mentioned housing 36. In particular, this housing can be a lubricant chamber that is assigned exclusively to the satellite cylinder 05, as shown, by way of example in FIGS. 1 and 7.

The manner of operation of the drive mechanism of a printing unit in accordance with the present invention is as follows:

During operation, such as during set-up and during production operations, the cylinder 01 is driven, and, in turn, drives the transfer cylinder 02 from the first drive motor 03. In a further development, the inking system 13 and, if provided, the dampening system 14 is also driven by this first drive motor 03. When the transfer cylinder 02 is pivoted in or out, the motor 03 driving the forme cylinder 02 can remain stationary and in a position for the ideal meshing of possibly cooperating pinions 11 and gear wheels 06.

If a correction of the lateral register, i.e. a lateral displacement of the printed image, is required, the cylinder 01 is displaced in the axial direction by an amount $\pm\Delta L$ by the use of a suitable drive mechanism, which is not specifically represented and which is preferably arranged on the side of the forme cylinder 01 that is located opposite to the drive mechanism, and thus without the drive motor 03 also having to be displaced.

In an embodiment with a drive motor 03 which is not coaxially arranged with respect to the forme cylinder 01, an axial displacement of the forme cylinder 01, without a simultaneous displacement of the circumferential register, is possible by the use of spur-toothed gearing between the gear wheel 06 and the pinion 11.

In another preferred embodiment, the axial displacement of the forme cylinder 01 is absorbed by the spur-toothed gearing of the gear 29, which is arranged between the drive motor 03, that is arranged axially with respect to the forme cylinder 01, and the forme cylinder 01.

A correction by the use of an electronic shaft between the cylinders 01, 02, as well as a mechanical readjustment of the circumferential register, can be omitted.

Wile preferred embodiments of a drive mechanism of a printing unit in accordance with the present invention have been set forth fully and completely hereinabove, it will be apparent to one of skill in the art that various changes in, for example the specific structure of the drive motors, the overall sizes of the cylinders, and the like could be made without departing from the true spirit and scope of the present invention which is accordingly to be limited only by the following claims.

What is claimed is:

1. A drive mechanism for a printing unit comprising:

a forme cylinder having a journal and being supported for rotation about an axis of rotation and shiftable in an axial direction through an axial distance;

a transfer cylinder acting with said forme cylinder and having a journal;

a common drive motor for said forme cylinder and said transfer cylinder;

a first gear drive between said common drive motor and said forme cylinder, said first gear drive being at least partially a spur gear drive; and a positive drive connection between said forme cylinder and said transfer cylinder, wherein power is transferred from said common drive motor to said forme cylinder through said first gear drive and from said forme cylinder to said transfer cylinder through said positive drive connection, said positive drive connection including at least one pair of cooperating spur-toothed members which are movable relative to each other in said axial direction.

2. The drive mechanism of claim 1 wherein said positive drive connection is a first gear wheel train.

3. The drive mechanism of claim 2 wherein said first gear wheel train includes a first gear wheel connected, fixed against rotation, with said transfer cylinder journal and a second gear wheel acting together with said first gear wheel and being connected, torsionally rigidly with said forme cylinder journal.

4. The drive mechanism of claim 3 wherein said positive drive connection is a toothed belt.

5. The drive mechanism of claim 3 further including an inking system cooperating with said forme cylinder and having a driving connection with said common drive motor.

6. The drive mechanism of claim 5 wherein said inking system is driven by said transfer cylinder through a second gear wheel train.

7. The drive mechanism of claim 5 wherein said driving connection includes a first gear wheel arranged, fixed against relative rotation, on said transfer cylinder journal, a second gear wheel acting with said first gear wheel and rotatably supported on said forme cylinder journal and a third gear wheel on said inking system and acting with said second gear wheel.

8. The drive mechanism of claim 5 wherein said driving connection is a toothed belt.

9. The drive mechanism of claim 1 further including an inking system, and wherein said inking system is driven in parallel from said forme cylinder by a driving connection.

10. The drive mechanism of claim 1 wherein said common drive motor includes a shaft, said shaft driving said forme cylinder and being parallel to and axially offset from said forme cylinder axis of rotation.

11. The drive mechanism of claim 1 wherein said common drive motor has a shaft, said shaft driving said forme cylinder and being parallel to and coaxial with respect to said forme cylinder axis of rotation.

12. The drive mechanism of claim 1 wherein said first gear drive includes a pinion and wherein said common drive motor has a shaft, said pinion being connected, fixed against relative rotation, with said shaft, and a gear wheel connected, fixed against relative rotation, with said forme cylinder.

13. The drive mechanism of claim 1 further including a counter-pressure cylinder acting with said transfer cylinder, said counter-pressure cylinder having no positive driving connection with said forme cylinder and said transfer cylinder.

14. The drive mechanism of claim 13 wherein said counter-pressure cylinder is a second transfer cylinder.

15. The drive mechanism of claim 13 wherein said counter-pressure cylinder is a satellite cylinder.

16. The drive mechanism of claim 13 wherein said counter-pressure cylinder is driven by a drive gear independent of said positive drive connection between said forme cylinder and said transfer cylinder.

17. The drive mechanism of claim 16 further including a drive motor for said counter-pressure cylinder, said drive motor driving said counter-pressure cylinder through said drive gear.

18. The drive mechanism of claim 1 wherein said first gear drive absorbs axial movement between at least one of said forme cylinder and said transfer cylinder and said common drive motor.

19. The drive mechanism of claim 1 wherein said positive drive connection allows a relative axial movement between said transfer cylinder and said forme cylinder with no relative change in circumferential position.

20. The drive mechanism of claim 1 wherein said first gear drive has at least two cooperating spur-toothed gear wheels.

21. The drive mechanism of claim 1 wherein a position of said first gear drive is fixed.

22. The drive mechanism of claim 1 further including a first lubricant chamber, said positive drive connection being arranged in said first lubricant chamber.

23. The drive mechanism of claim 22 wherein said first gear drive is in said first lubricant chamber.

24. The drive mechanism of claim 22 further including a second lubricant chamber and wherein said first gear drive is in said second lubricant chamber.

25. The drive mechanism of claim 16 further including a lubricant chamber and wherein said counter-pressure drive gear is in said lubricant chamber.

26. The drive mechanism of claim 1 wherein said first gear drive is a planetary gear.

27. The drive mechanism of claim 16 wherein said counter-pressure drive gear is a planetary gear.

28. The drive mechanism of claim 17 wherein each said drive motor includes an attached reduction gear.

29. A drive mechanism for a printing unit comprising:

a forme cylinder having a journal and being supported for rotation about an axis of rotation and being shiftable in an axial direction through an axial distance;

a transfer cylinder acting with said forme cylinder and having a journal, said transfer cylinder being in a positive driving connection with said forme cylinder, said forme cylinder and said transfer cylinder forming a cylinder pair;

a common drive motor driving said cylinder pair and being in engagement with said forme cylinder;

a satellite cylinder assigned to said cylinder pair;

a second drive motor driving said satellite cylinder independently of said cylinder pair;

a first reduction gear on said forme cylinder and in engagement with said common drive motor; and a second reduction gear on said satellite cylinder.

30. The drive mechanism of claim 17 wherein said first reduction gear absorbs axial relative movement between said forme cylinder and said common drive motor.

31. The drive mechanism of claim 30 wherein said positive drive connection allows a relative axial movement between said transfer cylinder and said forme cylinder with no relative change in circumferential position.

32. The drive mechanism of claim 30 wherein said positive drive connection includes at least one cooperating pair of spur-toothed members which can be moved relative to each other in said axial direction.

33. The drive mechanism of claim 30 wherein said first reduction gear is at least partially embodied with spur teeth.

34. The drive mechanism of claim 18 wherein said common drive motor is fixed in place.

35. The drive mechanism of claim 30 wherein said common drive motor is fixed in place.

36. The drive mechanism of claim 29 further including a first lubricant chamber, said positive drive connection being arranged in said first lubricant chamber.

37. The drive mechanism of claim 36 wherein said first reduction gear is in said first lubricant chamber.

38. The drive mechanism of claim 36 further including a second lubricant chamber and wherein said first reduction gear is in said second lubricant chamber.

39. The drive mechanism of claim 38 further including a third lubricant chamber, said second reduction gear being in said third lubricant chamber.

40. The drive mechanism of claim 29 further including a lubricant chamber, said second reduction gear being in said lubricant chamber.

41. The drive mechanism of claim 29 wherein said first reduction gear is a planetary gear.

42. The drive mechanism of claim 29 wherein said second reduction gear is a planetary gear.

43. The drive mechanism of claim 29 wherein each said drive motor includes an attached reduction gear.

* * * * *

UNITED STATES PATENT AND TRADEMARK OFFICE

CERTIFICATE OF CORRECTION

PATENT NO. : 6,901,854 B2
DATED : June 7, 2005
INVENTOR(S) : Bernd Kurt Masuch

It is certified that error appears in the above-identified patent and that said Letters Patent is hereby corrected as shown below:

Column 9,
Line 32, after "Claim," change "3" to -- 1 --; and

Column 10,
Line 63, after "claim," change "17" to -- 29 --.

Signed and Sealed this

Twenty-fifth Day of April, 2006

JON W. DUDAS
*Director of the United States Patent and Trademark Office*